US005692275A

United States Patent [19]

Freeman et al.

[11] Patent Number: 5,692,275

[45] Date of Patent: Dec. 2, 1997

[54] REMOTELY ACTUATABLE CLASP AND METHOD

[75] Inventors: Charles H. Freeman, Dallas; Morgan H. Dunn, Carrollton, both of Tex.

[73] Assignee: Cyberstrip, Inc., Dallas, Tex.

[21] Appl. No.: 723,691

[22] Filed: Sep. 30, 1996

[51] Int. Cl.[6] ..... A41F 1/00; H01H 9/00

[52] U.S. Cl. ..... 24/603; 463/51; 335/167

[58] Field of Search ..... 24/603, 606; 335/167; 361/172; 446/175; 463/51, 52; 273/371, 378, 383, 384, 385

[56] References Cited

U.S. PATENT DOCUMENTS

| | | | |
|---|---|---|---|
| 3,608,160 | 9/1971 | Coyle | 24/603 |
| 4,083,560 | 4/1978 | Kikuchi et al. | 463/51 |
| 4,307,361 | 12/1981 | Grunert et al. | 335/167 |
| 4,413,384 | 11/1983 | Lassche | 24/603 |

*Primary Examiner*—Victor N. Sakran

*Attorney, Agent, or Firm*—Crutsinger & Booth

[57] ABSTRACT

A remotely actuatable clasp responsive to photonic energy beams is provided. The clasp has a housing that defines a longitudinally extending latch cavity with a latch window. A photonic receiver circuit converts received photonic energy into an electrical signal. A latch member with a first end and a second end. The first end of the latch member has a latch head insertable into the latch cavity to the latch window. The second end of the latch member has a first attach point attachable to the garment. An electromechanical latch is electrically connected to said photonic receiver circuit and pivotally mounted to the housing. The electromechanical latch is engageable in a first position with the latch head through the latch window. The electromechanical latch is disengagable in a second position from the latch head in response to the electrical signal from the receiver circuit. A second attach point is positioned on the housing and is attachable to the garment. A first and a second terminal are provided that are adapted for electrically connecting a power supply with sufficient energy to power the photonic receiver circuit and the motor.

12 Claims, 6 Drawing Sheets

REMOTELY ACTUATABLE CLASP AND METHOD

TECHNICAL FIELD

This invention relates to a remotely operable clasp that releases a latch member in response to a received photonic energy signal from a remote photonic transmitter.

BACKGROUND OF THE INVENTION

Electromechanical target devices for use in war games or competition games are presently available that are typically complex and expensive, technologically intimidating, and cost-prohibitive to the consuming public at large. Furthermore, such equipment is cumbersome and not readily usable for other games or tasks.

An example of targeting devices in use are war games employing flak-style vests. Such equipment is used in entertainment centers that are devoted to "hide and seek" type war games. Players are issued a laser gun or other photonic energy source and a flak-style vest. During the game, players hunt each other and then "shoot" with the laser guns. When a receiver—mounted to the flak vest—detects a "hit" or receives the photonic energy signal from the gun, an alarm sounds alerting the player he or she was killed or injured. Such forms of war game entertainment are presently available. An example is Q-Zar, 9330 N. Central Expressway, Dallas, Tex.

But the equipment for these war games are devoted pieces of equipment. That is, if the popularity of the specific form of game declines, an equipment owner cannot readily convert this expensive equipment to another form of game which can make use of photonic technology. A need exists for laser game devices that are relatively inexpensive and have greater versatility for a use in multiple forms of gaming or entertainment.

SUMMARY OF THE INVENTION

A remotely actuatable clasp responsive to photonic energy beams is provided. The clasp has a housing that defines a longitudinally extending latch cavity with a latch window. A photonic receiver circuit converts received photonic energy into an electrical signal. A latch member with a first end and a second end. The first end of the latch member has a latch head insertable into the latch cavity to the latch window. The second end of the latch member has a first attach point attachable to the garment. An electromechanical latch is electrically connected to said photonic receiver circuit and pivotally mounted to the housing. The electromechanical latch is engageable in a first position with the latch head through the latch window. The electromechanical latch is disengagable in a second position from the latch head in response to the electrical signal from the receiver circuit. A second attach point is positioned on the housing and is attachable to the garment. A first and a second terminal are provided that are adapted for electrically connecting a power supply with sufficient energy to power the photonic receiver circuit and the motor.

A method of remotely releasing a clasp is also provided. The method comprises engaging a releasable latch member with the lobe of the cam. Receiving a photonic energy beam from a remote source with the photonic receiver and converting the received photonic energy signal into an electrical signal. Disengaging the releasable latch member by rotating the motor shaft in response to the electrical signal.

These and other features and advantages of the present invention will be apparent to those skilled in the art upon reading the following detailed description of preferred embodiments and referring to the drawing.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which.

DETAILED DESCRIPTION OF PREFERRED EMBODIMENT

Figure 1:
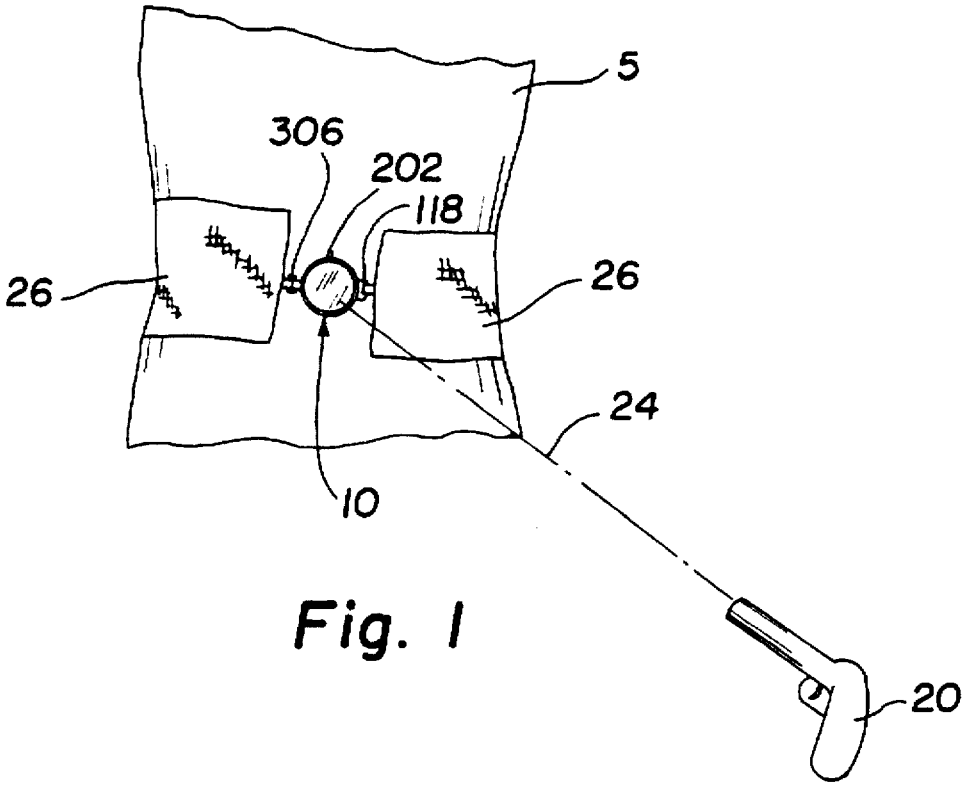
FIG. 1 is an illustration of the invention on a human torso used in a form of war game.
Figure 2:
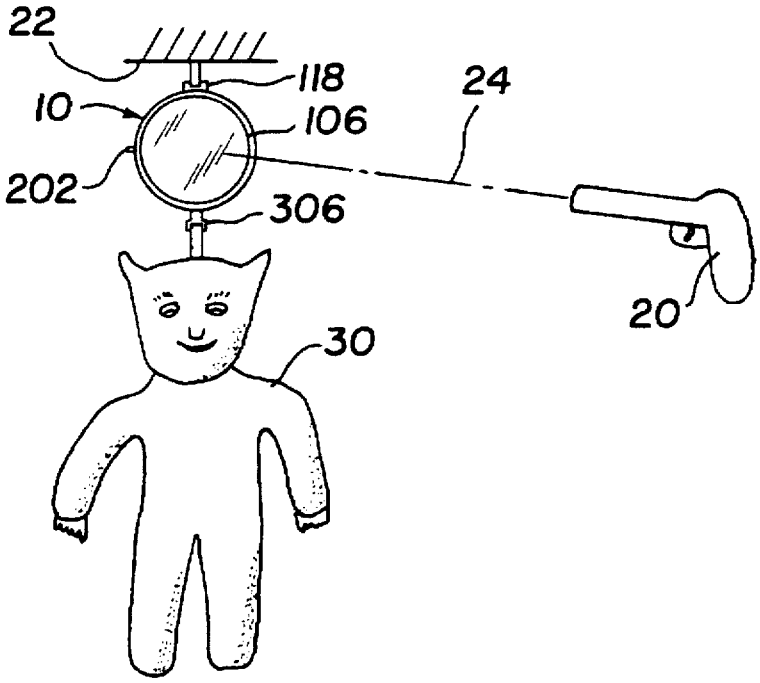
FIG. 2 is an illustration of the invention used in a carnival-type game.

An embodiment of a remotely operable clasp, generally designated by the numeral 10, is shown in FIG. 1. In FIG. 1, clasp 10 is shown used for a wargame. Clasp 10 is attached through attach point 118 and attach point 306 to a piece of fabric or material 26 around a torso 5. When laser gun 20 fires or directs a beam of photonic energy radiation at clasp 10, latch member 306 is released, thereby releasing fabric 26 and alerting the player that he or she has been hit. FIG. 2 illustrates another game where clasp 10 is used in a carnival-type game where a carnival-type prize 30 is suspended from a beam 22 through clasp 10. For clarity, only one prize is shown, but it should be noted that a variety of prizes can be similarly suspended at varying distances and locations of increasing difficulty and skill for an added degree of challenge with more valuable prizes. When photonic energy is received by clasp 10, prize 30 is separated from the beam 22 and falls to the ground. The game participant can then claim their prize.

Figure 3:
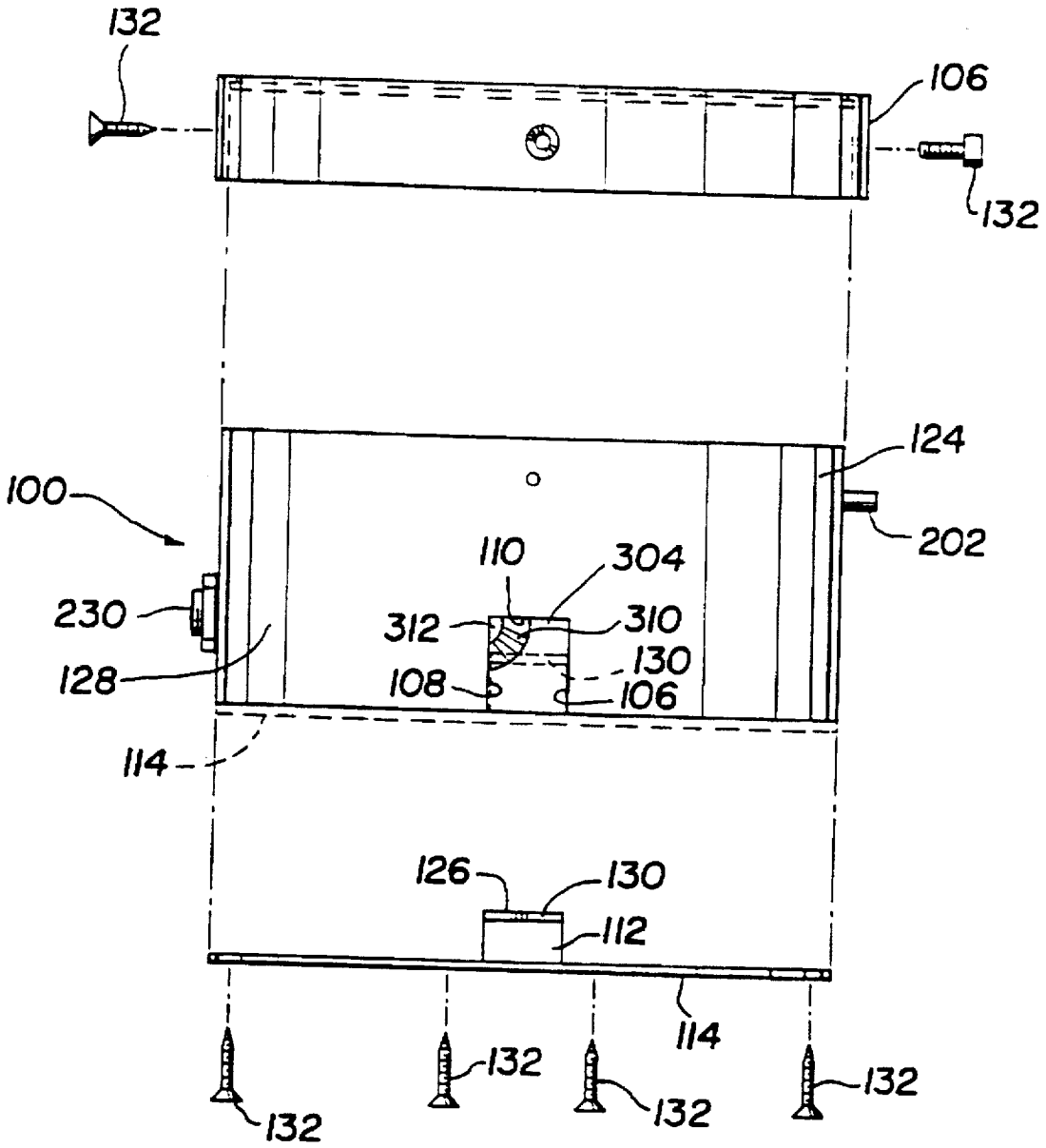
FIG. 3 is an exploded plan view of the housing of the invention.

Referring to FIG. 3, an exploded plan view of housing 100 is shown. Substantially cylindrical body portion 124 defines latch cavity with bottom body portion 110, first side body portion 106, wall portion 116, and surface 126. First side body portion 106 extends from outer surface 128 to wall portion 116, which is generally perpendicular to body portion 106. Similarly, second side body portion 108 extends from outer surface 123 at a generally perpendicular angle relative to wall portion 116, but does not intersect wall portion 116. Second side body portion 108 stops short of wall portion 116, forming a latch window for cam 312 to extend into latch cavity 304 (best shown in FIGS. 5 and 6). Chamfered edge 130 assists latch member 302 when inserted into latch cavity 304. Illustrated in phantom lines, bottom plate is secured to cylindrical body portion 128, forming latch cavity 304. Bottom plate 114 is secured to cylindrical body portion 128 with a plurality of bolts or screws 132.

Figure 4:
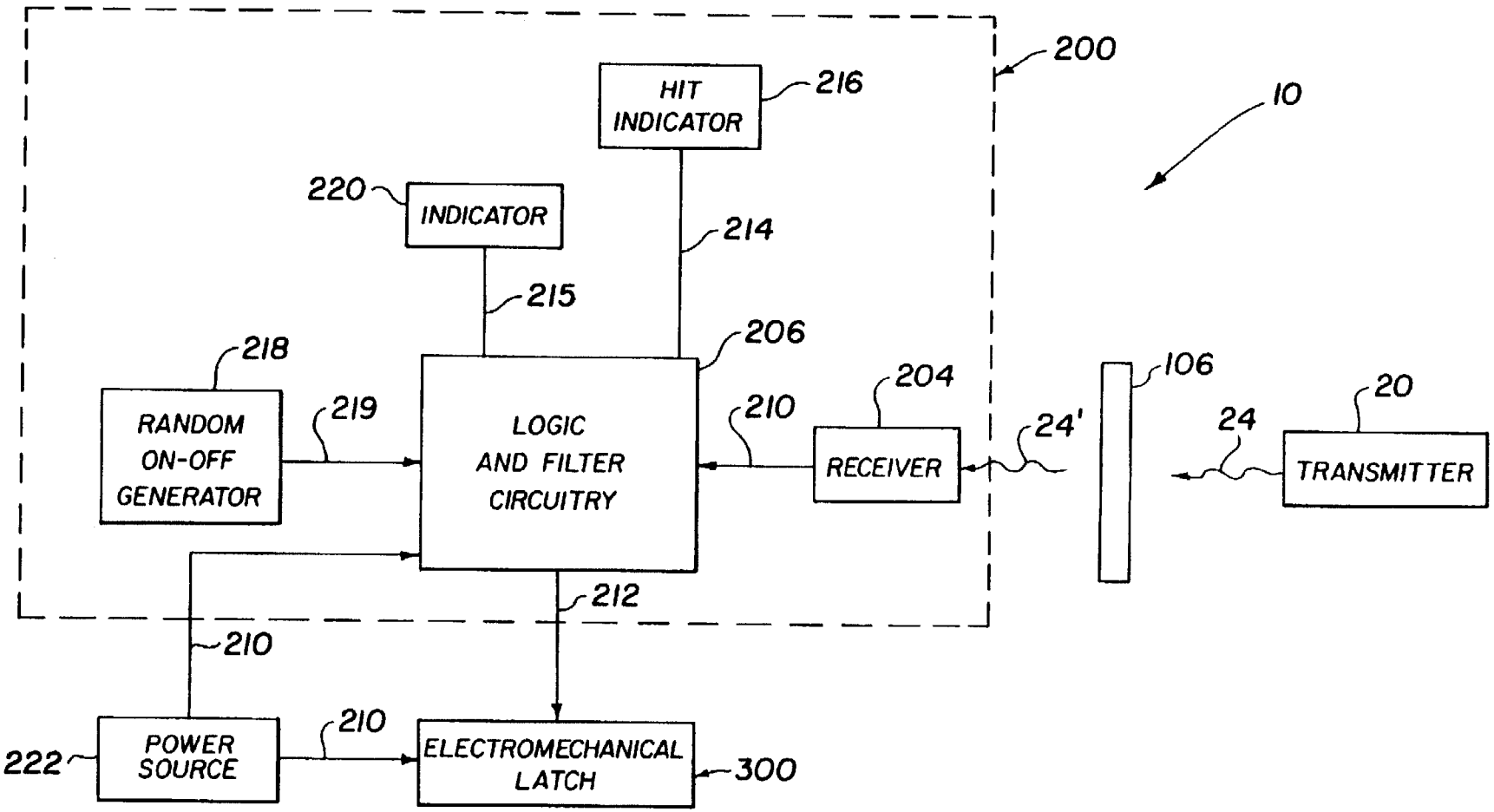
FIG. 4 is a block diagram of the invention.

Referring to FIG. 4, a block diagram of clasp 10 is shown. Transmitter 20, which can be in the form of a laser-light gun, transmits or shoots a photonic energy beam 24 at clasp 10. Energy beam 24 can be in the form of low-intensity energy beam such as infrared or low-level laser light. Such a suitable energy beam has a wavelength of about 543 nanometers, which is available with current laser technology. Energy beam 24 is dispersed through optic filter 106. That is, optic filter 106 disperses incoming energy so that a precise hit is not necessary to trigger receiver 204. Different filters can be used to vary the amount of precision necessary for receiver 204 to register or recognize beam 24, accordingly. Dispersed energy beam 24' is received by receiver 204. Receiver 204 converts energy beam 24' to an electrical signal representation, typically a voltage value. Receiver 204 is electrically connected to logic and filter circuit 206 through conductors or circuit board runs 210. An example of suitable conductors or circuit board runs 210 are copper-based wire or etched-copper circuit boards. Logic and filter circuit 206 processes the electrical output of receiver 204. That is, extraneous noise such as white noise or the like is filtered out. Logic circuitry tests the filtered electrical signal by its frequency signature and magnitude. If the filtered electrical signal is determined to be from transmitter 20, then logic and filter circuit 206 transmits an electrical signal through conductor or board runs 212 to trigger latch mechanism 300. Latch mechanism 300 is discussed later in detail herein. Logic and filter circuit 206 also transmits another electrical signal through conductor 214 to hit indicator 216. Hit indicator 216 can be either an audio or visual alarm. In the preferred embodiment, hit indicator 216 is a plurality of LEDs (Light Emitting Diodes) that flash in a random pattern.

For further gamesmanship, random on-off circuitry 218, electrically connected to logic and filter circuit 206 through conductors 219, is provided to randomly cause logic and filter circuitry 206 into either active- or sleep-modes. When in sleep-mode, the logic and filter circuit 206 does not act upon the received energy beam 24. Also, indicator 220, typically another LED, is not illuminated. When in active-mode, the logic and filter circuit 206 acts on the received energy beam 24 and indicator 220 is illuminated, informing the game participant that the clasp 10 is in active mode and that their laser gun "rounds" will not be wasted.

Power source 222 is electrically connected to electrical components in the photonic receiver circuit 200 and latch mechanism 300 through plurality of conductors or circuit-board runs 210. Power source 222 is a commercially available power source sufficient to power discrete semiconductor components and of a size containable within housing 100 (shown in FIG. 5).

Figure 5:
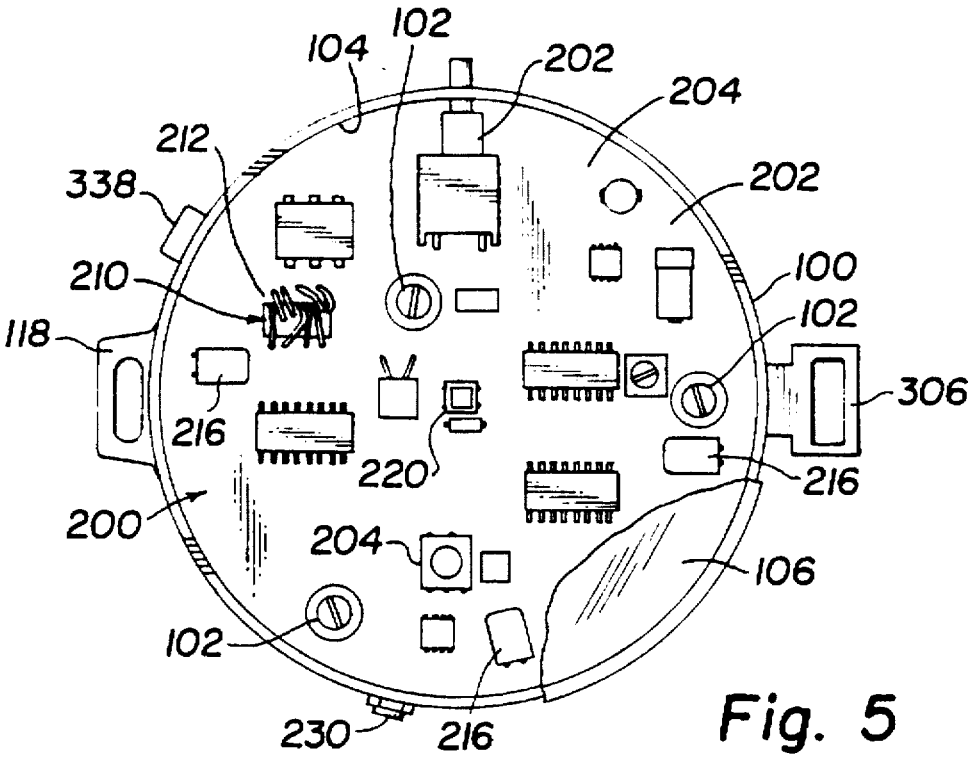
FIG. 5 is an plan view of the photonic receiver circuit of the invention embodied in a printed-circuit board.

Referring to FIG. 5, a component board layout for receiver circuit 200 is shown. The electrical components of receiver circuit 200 are mounted on a conventional printed-circuit board which is secured to housing 100 with bolts 102, adhesives, or the like. Because commercially-available electrical components tend to extend above the surface 204 of circuit board 202, board 202 is recessed in housing 100. Circuit 200 is activated when start-button 202 is pressed. Such receiver circuits are commercially available. For example, a suitable receiver circuit 200 can be obtained from Laser Star Technologies, Davie, Fla.

Housing 100 is substantially cylindrical and has a radial dimension of about 1.25 inches (about 3.18 centimeters) and a height of about 1 inch (about 2.54 centimeters). Housing 100 is made of a strong, durable, light-weight material. Such a material is a hardened plastic that can be heated to be poured into a mold, or machined to a final shape. Both receiver circuit 200 and latch mechanism 300 are contained in housing 100. But it should be noted that receiver circuit 200 and latch mechanism 300 can be placed apart, so that a remotely placed receiver circuit 200 can be electrically connected to latch mechanism 300 to release fabric 26. For example, photonic receiver circuit 200 can be incorporated into a head band and a conductor leads to latch mechanism 300 that is clasping the fabric. An advantage of this configuration is that it is more difficult for a player to "cheat" by concealing their target.

Figure 6:
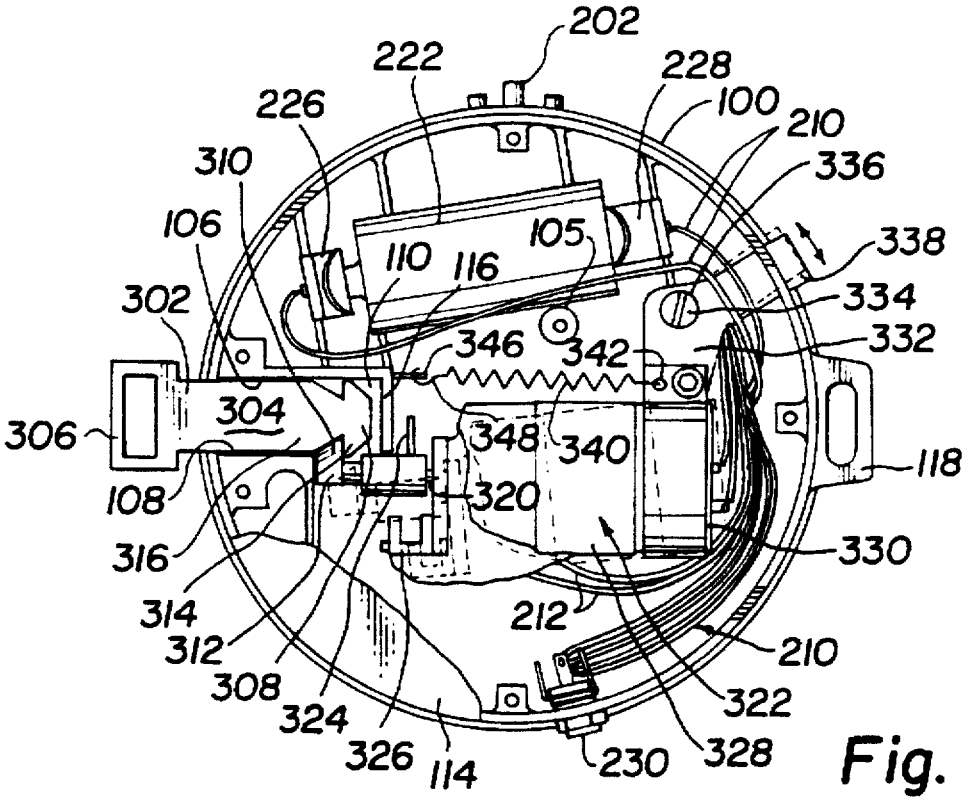
FIG. 6 is a plan view of the electromechanical latch of the invention showing the motor assembly in an engaged and a release position.

Referring to FIG. 6, the latch mechanism 300 is shown embodied by a DC motor actuation configuration having a DC motor 322 with a cam 312 mounted to motor shaft 320. Latch member 302 is shown inserted in latch cavity 304. Latch member 302 is sized sufficient to at least be used in the type of games disclosed herein. A suitable size is a width of about 0.25 inches (about 64.5 millimeters) and a length of about 1 inch (about 2.54 centimeters). A suitable thickness of latch member 302 is about one-sixteenth inch (about 1.6 millimeters). Preferably, latch member 302 is made of a strong durable material that can withstand repeated insertion into clasp 10. For example, such a material is stainless steel.

Latch cavity 304 is defined by first side body portion 106 and second body portion 108. Bottom body portion 110 and top body portion 112 extending from bottom plate 114 (shown in FIG. 8). On a first end of latch member 302 is latch head 308 engageable with lobe 310 of rotatable cam 312. Latch head 308 has a substantially trapezoidal head 314 extending from tapered latch section 316. As shown, latch member 302 is substantially symmetrical, but it should be noted that latch member 302 can be asymmetrical. That is, a single latch head portion on one side of the latch member 302 for engaging lobe 310. On a second end of latch member 302 is attach point 306. Attach point 306 is a substantially rectangular tab used to attach across fabric 26 or to suspend carnival prizes 30 or the like. Second attach point 118 is positioned on housing 100. Second attach point 118 is attachable to the fabric 26, carnival prize 30, or the like. As shown, second attach point 118 is positioned substantially opposing first attach point 306 on latch member 302, but it should be noted that second attach point 118 can be positioned elsewhere on housing 100.

Rotatable cam 312 is mounted on motor shaft 320 of DC motor 322. Attached to a lower end of cam 312 is stop position flag 324. When the cam rotates, stop position flag 324 passes through stop position sensor 326. Stop position sensor 326 is attached to motor housing 328 through rigid attachment member 330. This configuration serves to alert receiver circuit 200 that latch member 302 has been released, and further stops or returns the lobe 310 in a first or engaged position to engage latch member 302 when inserted in latch cavity 304.

Motor mounting bracket 332 is tightened about lower end 330 of motor housing 328 and secured by a bolt or other such device. Mounting bracket 332 has a pivot axis 334 wherein a bolt or pin 336 pivotally secures motor 322 to housing 100.

Coiled spring 340 has first hooked end 342 secured adjacent to motor 322 on mounting bracket 332 through aperture 344. Second hooked end 348 of coiled spring 340 is secured to spring mount 346 such that spring 340 biases cam 312 and lobe 310 in a first or engage position, shown in FIG. 6. When in the first position, spring 340 urges cam 312 against a vertical edge of wall portion 116.

Release lever 338 extends from mounting bracket 332 at pivot axis 334 to the outside of housing 100. Release lever 328 permits manual release of clasp 10 in the event the game participant's aim is particularly poor. Clasp 10 can be released by urging lever 338 about pivot axis 334 to pivot motor mounting bracket 332 and motor 322, respectively, into a second or release position, shown in FIG. 6 in phantom lines.

Power source 222 is in electrical contact with first and second terminals 226 and 228, respectively. Power source 222 is of a voltage suitable to power photonic receiver circuit 200 and motor 322, which is responsive to circuit 200. Terminals 226 and 228 are electrically connected to photonic receiver circuit 200 and motor 322 through a plurality of conductors 210. Conductors 210 are electrically connected to a charge receptacle port 230. Receptacle port 230 allows the connection external power sources to recharge power source 222. A suitable power source is a 1.2 VDC (Volts Direct Current) rechargeable battery.

Figure 7:
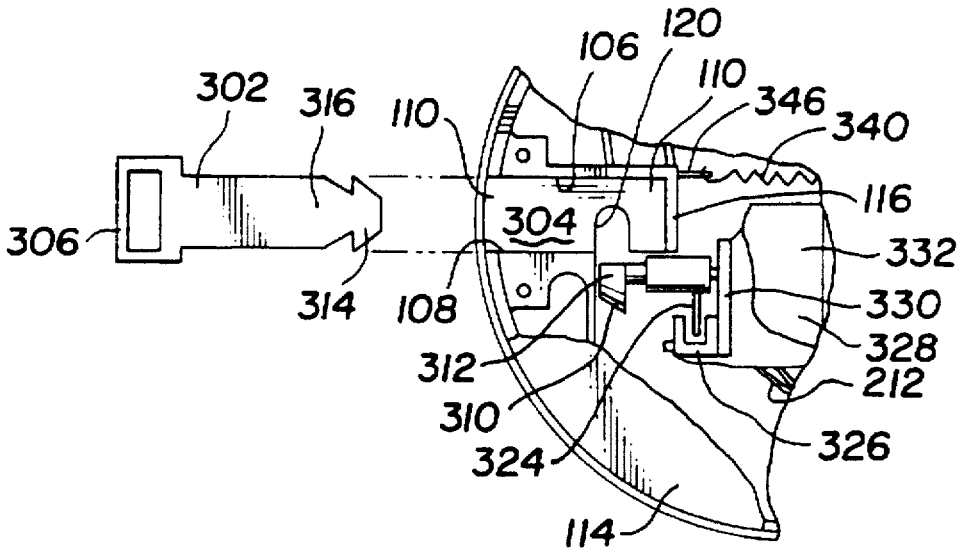
FIG. 7 is a partial view of the electromechanical latch of the invention with the cam shown in a disengage position.

Referring to FIG. 7, cam 312 and lobe 310 are shown in a disengaged position. Motor 322 responds to an electrical signal from receiver circuit 200 (see FIGS. 4 and 5) over conductors 212. Motor 322 responds by rotating motor shaft 320. When rotating, shaft 320 also rotates cam 312, lobe 310, and stop position flag 324. When flag 324 intersects sensor 326, a flag signal is placed on conductor lines 212 that is tested by receiver circuit 200. Upon receipt of the flag signal, receiver circuit 200 resets cam 312 and lobe 310 to an engage position as shown in FIG. 6.

Figure 8:
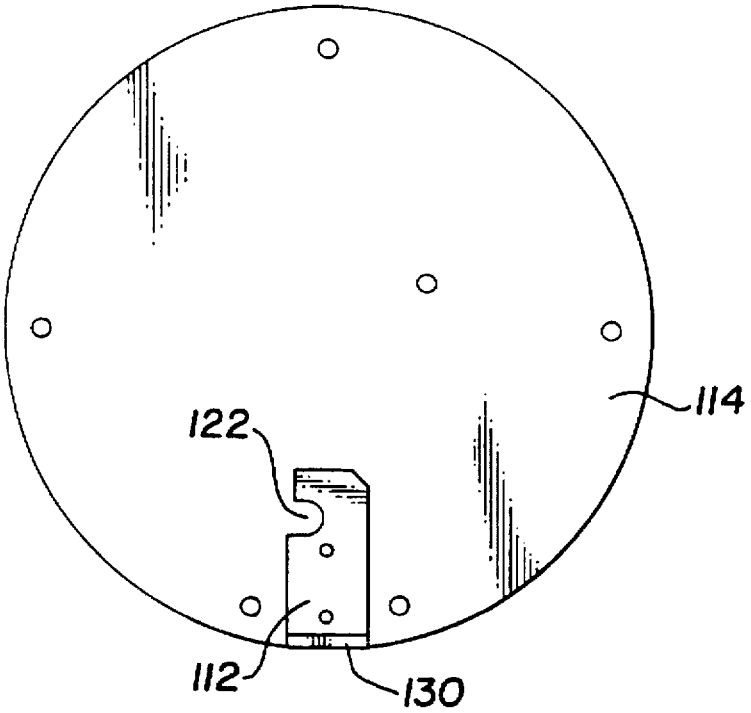
FIG. 8 is a plan view of a bottom plate of the invention.

Referring to FIG. 7, bottom body portion 100 has a fluted surface 120 to receive lobe 310 and to further reinforce the engagement of latch member 302 with lobe 310. A corresponding fluted surface 122 is defined on top body portion 112 on plate 114, as shown in FIG. 8. Top body portion 112 is sized to slidingly fit between first and second side portions 106 and 108. When cam lobe 310 is rotated away from fluted surfaces 120 and 122, cam back portion 350 substantially aligns with second side body portion 108 such that protruding edges are minimized, allowing latch head 314 to clear the latch cavity 304 with minimum interference, accordingly, and disengage from clasp 10.

Figure 9:
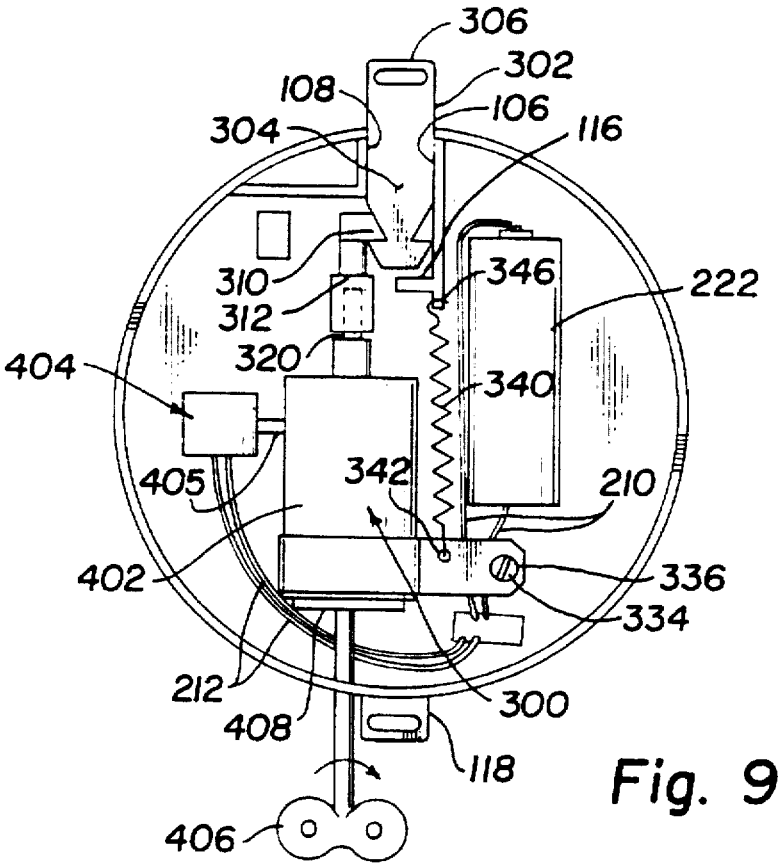
FIG. 9 is another embodiment of the electromechanical latch having a wind-up spring motor activated by a solenoid.

With respect to latch mechanism 300, other electromechanical embodiments can be used. For example, FIG. 9 illustrates an example of the clasp 10 with a wind-up mechanical spring motor 402. For clarity, the structure as set out in FIG. 7 is omitted, with the understanding that spring motor 402 is generally interchangeable with motor 322. Spring motor 402 is commonly available and is not discussed in further detail. Start solenoid 404 is connected to spring motor 402 to actuate the motor's internal spring mechanism. Start solenoid 404 is electrically connected to receiver 200 (shown in FIGS. 4 and 5) through conductors 212. Receiver circuit 200 transmits an electrical signal through conductor or board runs 212 to trigger solenoid 404. Potential energy is stored by the internal spring mechanism by rotating removable motor key 406. Motor key 406 can be inserted into base 408 through an aperture in housing 100 sized sufficient to accept a shaft of key 406. When motor 400 has stored sufficient potential energy to rotate its shaft—typically indicated by an increased resistive angular force urging against the shaft of key 406—key 406 is removed.

Figure 10:
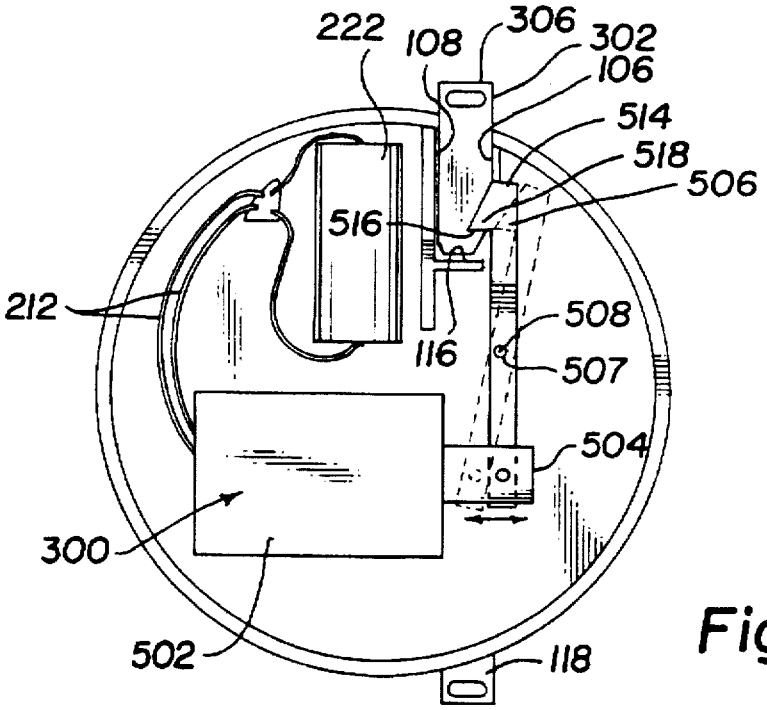
FIG. 10 is yet another embodiment of the electromechanical latch having a solenoid attached to a pivot latch.

Referring to FIG. 10, yet another electromechanical latch mechanism 300, is shown in which solenoid 502 has an axially extending member 504. Again, for clarity, the structure as set out in FIG. 7 is omitted, with the understanding that solenoid 502 is generally interchangeable with motor 322. Axially extending from solenoid 502 is member 504, which is urged by solenoid 502 in an extended or first position. Solenoid 502 is connected to pivotally mounted latch 506. Latch 506 is pivotally mounted through a mounting aperture 507 about pin 508, which extends upwards from housing 100. Solenoid 502 is electrically connected to receiver 200 (shown in FIGS. 4 and 5) through conductors 212 through portal 510. Receiver circuit 200 transmits an electrical signal through conductor or board runs 212 to trigger solenoid 502. Responding to the electrical signal, solenoid 502 retracts plunger member 504 inside, causing latch 506 to pivot about pin 508 into a release position depicted in phantom lines in FIG. 10. When in the release position, latch member 512 is retracted from housing 100. Latch member 512 has an asymmetrical head 514 defining a substantially triangular notch 516. Notch 516 generally engages latch 506 at hooked head 518.

The term "solenoid," as used herein, means an electrically energized coil which may have one or more layers of windings. Such solenoids are commonly available. Solenoids 402 and 502 are a plunger-type solenoid with a coil wound on a non-magnetic form in which a magnetic plunger member 405 and 504, respectively, may move. Referring to FIG. 9, energizing the internal coil of solenoid 404 pulls plunger 405 into the coil, releasing the internal spring of wind-up motor 402. Referring to FIG. 10, energizing the internal coil of solenoid 502 pulls the plunger up into the coil 504 and thus operates to move the pivotally connected latch 506 from an engage or first position, to a disengaged or second position.

With the clasp 10, a remote releasing method is provided. As stated above, clasp 10 has a motor 322 responsive to photonic receiver circuit 200. Motor 322 has cam 312 attached to motor shaft 320 such that cam 312 has a corresponding angular velocity with shaft 320. Releasable latch member 302 engages lobe 310 of cam 312. That is, when inserted into latch cavity 304, latch head 308 is urged against a sloped outer surface of cam lobe 310. As latch head 308 is urged against lobe 310, motor 322 is pivoted about pivot axis 334. Spring 340 is extended, storing energy so that once head 308 is urged past lobe 310, motor 322 retrains to the first or engaged position (shown in FIG. 6), wherein lobe 310 is received in tapered section 316. A received photonic energy signal or beam 24 or dispersed beam 24' is converted into an electrical signal by receiver circuit 200. Responding to the electrical signal, motor shaft 320 of motor 322 rotates, rotating lobe 310 from the tapered section 316 of latch head 308. Once lobe 310 is removed from tapered section 316, latch member 302 disengages from clasp 10. Latch member 302 is generally urged from latch cavity 304 by a tensile force generated by a tightened attachment from the garment shown in FIG. 1 or by a tensile force generated by gravity, such as that shown in the carnival-style game in FIG. 2. Other devices can be used to urge latch member 302 from latch cavity 304, such a as a coiled spring between latch head 308 and wall portion 116. Other game variations may be had, such as incorporating clasp 10 in a woman's brassiere such that the brassiere comes off when clasp 10 is triggered by laser gun 20.

The description and figures of the specific examples above do not point out what an infringement of this invention would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined in the following claims.

Having described the invention, what is claimed is:

1. A remotely actuatable clasp for a garment comprising:

a housing defining a longitudinally extending latch cavity with a latch window;

a photonic receiver circuit for converting received photonic energy into an electrical signal;

a latch member having a first end and a second end, said first end having a latch head insertable into said latch cavity to said latch window and said second end having a first attach point attachable to the garment;

an electromechanical latch electrically connected to said photonic receiver circuit, said electromechanical latch engageable in a first position with said latch head through said latch window and disengagable in a second position from said latch head in response to said electrical signal;

a second attach point positioned on said housing attachable to the garment; and a first and a second terminal adaptable for electrically connecting a power supply having sufficient energy to power said photonic receiver circuit and said electromechanical latch.

2. The remotely actuatable clasp as defined in claim 1 wherein said received photonic energy is from a source remote from said photonic receiver circuit.

3. The remotely actuatable clasp as defined in claim 1 wherein said photonic receiver circuit is mounted within said housing.

4. The remotely actuatable clasp as defined in claim 1 wherein said electromechanical latch comprises:

a DC motor having a shaft, said motor pivotally mounted to said housing such that said motor is biased in a first position wherein said shaft is generally parallel to said longitudinally extending latch cavity, wherein said motor is electrically connectable to said receiver circuit and responsive to said electrical signal; and a radial cam having a lobe, said cam mounted to said shaft, said lobe extending into said latch cavity when said cam is in an engage position for engaging said latch head.

5. The remotely actuatable clasp as defined in claim 1 wherein said electromechanical latch comprises:

a wind-up spring motor having a shaft, an internal spring and an actuator switch, said motor pivotally mounted to said housing such that said motor is biased in said first position wherein said shaft is generally parallel to said longitudinally extending latch cavity;

a radial cam having a lobe, said cam mounted to said shaft, said lobe extending into said latch cavity through said latch window when said cam is in said engage position for engaging said latch head; and a solenoid having an axially extending plunger member engaging said actuator switch for selectably operating said wind-up spring motor, wherein said solenoid electrically connectable to said receiver circuit and responsive to said electrical signal.

6. The remotely actuatable clasp as defined in claim 1 wherein said electromechanical latch comprises:

a solenoid having an axially-extending plunger member with a first end, said solenoid electrically connectable to said receiver circuit and responsive to said electrical signal;

a pivot latch having an engagement end and a second end pivotally mounted to said first end of said plunger member, said pivot latch mounted about a generally central fulcrum point to said housing such that when said plunger member is in a first position, said engagement end is engageable with said latch head through said latch window and when said plunger member is in said second position said engagement end is disengagable with said latch head through said latch window.

7. The remotely actuatable clasp as defined in claim 1 further comprising:

a stop position sensor; and a stop position flag mounted about said cam such that said stop position sensor detects said stop position flag when said shaft rotates.

8. The remotely actuatable clasp as defined in claim 1 further comprising:

a random on-off circuit for forcing said photonic receiver circuit to randomly alternate between a sleep-mode and an active mode.

9. The remotely actuatable clasp as defined in claim 8 further comprising:

a visual indicator for indicating when said photonic receiver is in said active mode.

10. The remotely actuatable clasp as defined in claim 1 further comprising:

a release lever extending from said motor for mechanically urging said lobe from said latch cavity.

11. The remotely actuatable clasp as defined in claim 1 further comprising:

an ejection spring compressible between said first end of said latch member and an end portion of said latch cavity defined by said housing.

12. The remotely operable clasp as defined in claim 11 wherein said ejection spring has a first end mounted to said end portion of said latch cavity.

* * * * *

UNITED STATES PATENT AND TRADEMARK OFFICE

CERTIFICATE OF CORRECTION

PATENT NO. : 5,692,275

DATED : December 2, 1997

INVENTOR(S) : Freeman et al.

It is certified that error appears in the above-identified patent and that said Letters Patent is hereby corrected as shown below:

In Column 2, line 67, change "123" to --128--; and

In Column 6, line 47 change "retrains" to --returns--.

Signed and Sealed this

Twenty-second Day of September, 1998

*Attest:*

Bruce Lehman

BRUCE LEHMAN

*Attesting Officer*

*Commissioner of Patents and Trademarks*